US007811051B2

(12) United States Patent
Wagner

(10) Patent No.: US 7,811,051 B2
(45) Date of Patent: Oct. 12, 2010

(54) PUMP WITH CUTTING IMPELLER AND PRE-CHOPPER

(75) Inventor: Peter Wagner, Werdohl (DE)

(73) Assignee: Brinkmann Pumpen K.H. Brinkmann GmbH & Co. KG, Werdohl (DE)

( * ) Notice: Subject to any disclaimer, the term of this patent is extended or adjusted under 35 U.S.C. 154(b) by 681 days.

(21) Appl. No.: 11/816,630

(22) PCT Filed: Feb. 16, 2006

(86) PCT No.: PCT/EP2006/001375

§ 371 (c)(1),
(2), (4) Date: Aug. 18, 2007

(87) PCT Pub. No.: WO2006/099921

PCT Pub. Date: Sep. 28, 2006

(65) Prior Publication Data

US 2008/0152481 A1 Jun. 26, 2008

(30) Foreign Application Priority Data

Mar. 24, 2005 (DE) ..... 10 2005 014 348

(51) Int. Cl.
*F04D 29/70* (2006.01)

(52) U.S. Cl. ..... 415/121.1; 415/169.1; 416/198 R

(58) Field of Classification Search ..... 415/121.1, 415/121.2, 169.1, 121.3, 143; 416/175, 203, 416/198 R
See application file for complete search history.

(56) References Cited

U.S. PATENT DOCUMENTS

| | | | | |
|---|---|---|---|---|
| 3,128,051 | A | 4/1964 | Smith | |
| 5,460,483 | A | 10/1995 | Dorsch | |
| 6,190,121 | B1 * | 2/2001 | Hayward et al. | 415/121.1 |
| 6,224,331 | B1 | 5/2001 | Hayward et al. | |
| 7,125,221 | B2 * | 10/2006 | Dorsch et al. | 415/121.1 |

FOREIGN PATENT DOCUMENTS

| | | |
|---|---|---|
| DE | 2618559 | 11/1977 |
| JP | 57-32097 A | 2/1982 |
| JP | 10-503818 A | 4/1998 |
| WO | 96/04467 A1 | 2/1996 |

* cited by examiner

*Primary Examiner*—Edward Look
*Assistant Examiner*—Dwayne J White
(74) *Attorney, Agent, or Firm*—Richard M. Goldberg

(57) ABSTRACT

Pump having a cutting impeller (38), counter knives (40) associated therewith, and a pre-chopper (48) which is driven by a shaft portion (46) that projects axially from the cutting impeller (38), characterised in that the counter knives (40) carry a cutting edge (52) that extends in longitudinal direction of the shaft portion (46).

6 Claims, 2 Drawing Sheets

PUMP WITH CUTTING IMPELLER AND PRE-CHOPPER

The invention relates to a pump having a cutting impeller, counter knives corresponding therewith, and a pre-chopper that is driven by a shaft portion that projects axially from the cutting impeller.

In practice, a pump of this type has become known, which is employed for example in machine tools for conveying lubricating coolant emulsions that are contaminated with metal chips. This pump is a centrifugal pump which, in addition to the radial impeller, has an upstream axial impeller that is configured as cutting impeller and has an upstream end provided with cutting edges that cooperate with stationary counter knives that are radially arranged in the intake opening, so that chips and other contaminants that are sucked in can be cut and chopped. Coarse contaminants are chopped with the pre-chopper before they are sucked in by the axial impeller and are chopped further.

It is an object of the invention to provide a pump of the type indicated above with further improved chopping properties.

In order to achieve this object, according to the invention, the counter knives have a cutting edge extending in longitudinal direction of the shaft portion.

This cutting edge serves in particular for chopping fibrous material such as long metal chips, filaments from cloth, and the like, which would otherwise have the tendency to wind up firmly on the shaft portion. Due to the swirling motion of the medium flowing into the intake tube, which swirling motion is induced by the pre-chopper, and due to the suction of the axial impeller and the scissor action of the cutting impeller and the counter knives, the fibers are subject to such forces, that they are firmly dragged against the cutting edge and are then cut by the cutting edge. In this way, the fibers are prevented from settling permanently on the shaft portion, and a greater robustness of the pump is achieved in media which are strongly contaminated with fibrous material.

Useful embodiments and further developments of the invention are indicated in the dependent claims.

Preferably, the stationary counter knives carry a sleeve which surrounds and protects the rotating shaft portion and is formed at its outer periphery with the cutting edge extending in essential axial direction, or, preferably, with a plurality of such cutting edges.

In a particularly preferred embodiment, the cutting edges of the counter knives and/or the corresponding cutting edges of the cutting impeller are toothed, so that the material to be chopped can better be gripped. In particular, the toothed cutting edges of the cutting impeller have the effect that they entrain the fibrous material in circumferential direction and thus draw it firmly against the periphery of the sleeve and hence against the cutting edge.

An embodiment example will now be explained in detail in conjunction with drawings, wherein.

Figure 1:
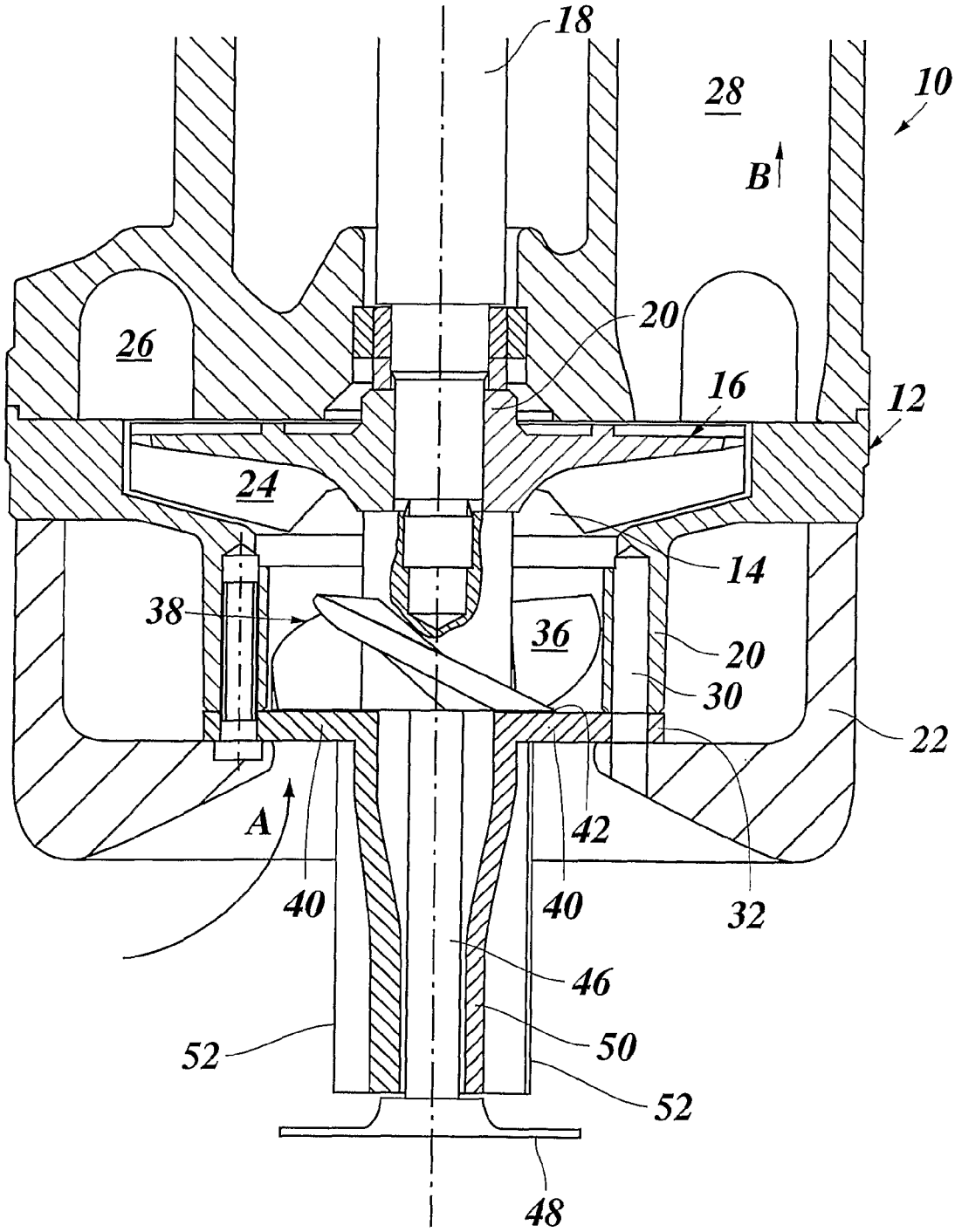
FIG. 1 is an axial sectional view of a pump according to the invention.

The centrifugal pump shown in FIG. 1 has an essentially cylindrical housing 10 with a head 12 flanged to the lower end thereof, and this head plunges into a liquid reservoir, that has not been shown, in a base of a machine tool. The head 12 forms a pump chamber 14 which accommodates a radial impeller 16. A shaft 18 is coaxially supported in the housing 10, and the top end of the shaft is connected to a drive motor that has not been shown and is supported in fixed bearings that have not been shown. These bearings determine the axial position of the shaft 18. The radial impeller 16 is keyed onto the lower end of the shaft 18. A wall of the head 12, which forms the lower part of the pump chamber 14, forms a downwardly projecting intake tube 20 coaxial with the impeller 16 and the shaft 18 and surrounded by an intake funnel 22.

The impeller 16 is a semi-open impeller equipped with downwardly open blades 24. These blades are inclined such that the liquid is sucked-in via the intake tube 20 (arrow A), and is then conveyed radially outwardly into a ring chamber 26 above the outer periphery of the pump chamber 14. Thanks to the liquid pressure that is created in the ring chamber 26 in this way, the liquid flows upwardly in the direction of an arrow B through a rising channel 28 formed in the housing 10 and towards a pump outlet port that has not been shown.

At the internal peripheral wall of the intake tube 20, a number of vent channels 30 are distributed in circumferential direction and connected to the pump chamber 14. An intake plate 32 is arranged at the lower end of the intake tube 20, and the vent channels 30 are open to the bottom side of the intake plate. The intake plate 32 closes-off the pump chamber 14 at the bottom side and has an intake opening 34 (FIG. 2).

An axial impeller 38, which is equipped with helical blades 36, is arranged on the shaft 18 inside of the intake tube 20. The axial impeller 38 conveys the liquid from the lower end of the intake tube 20 through the intake opening 34 and axially upwards into the inner portion of the pump chamber 14. In this way, the throughput of the pump is increased significantly.

Figure 2:
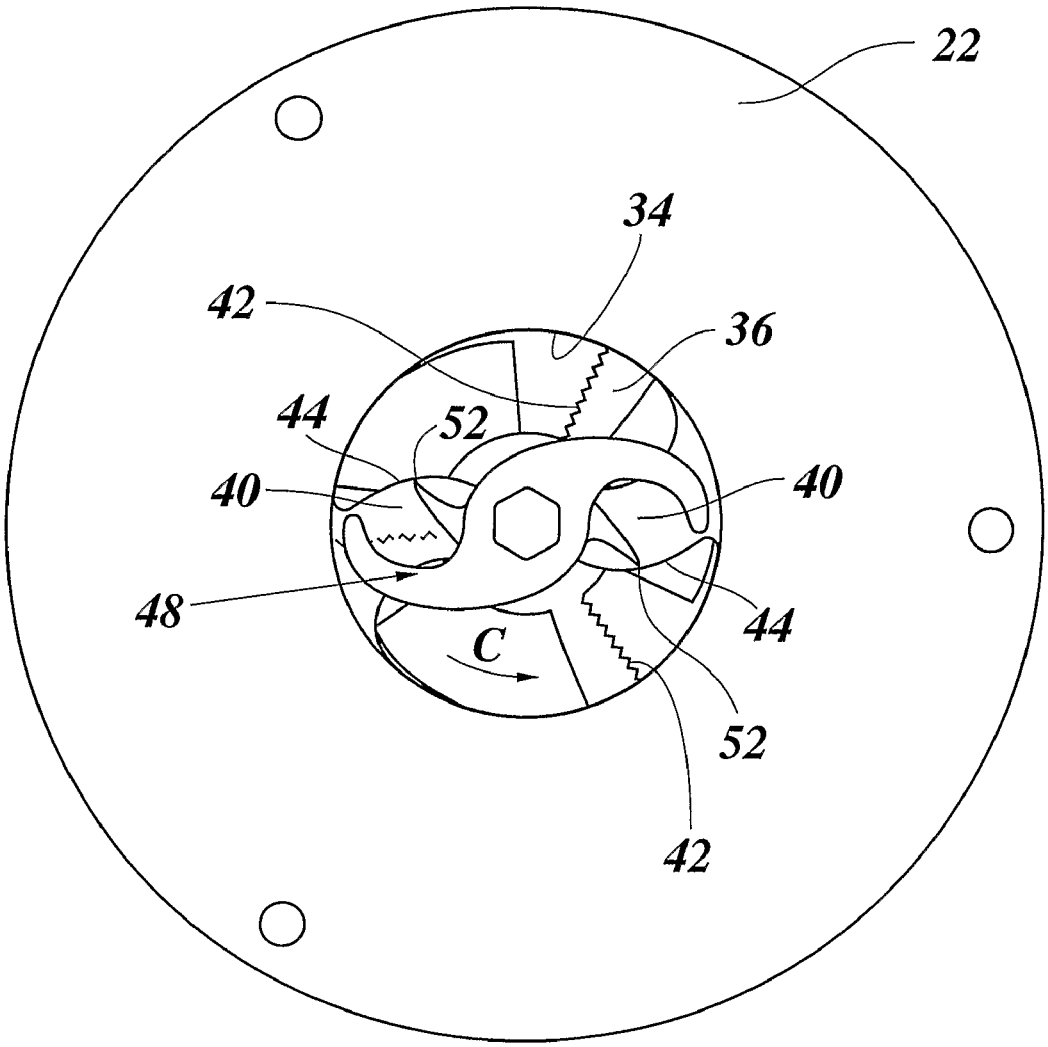
FIG. 2 shows the pump according to FIG. 1 in view from below.

FIG. 2 is a view of the pump as seen from the bottom side in FIG. 1. Three blades 36 of the cutting impeller are visible in the intake opening 34. The intake plate 32 forms two counter knives 40 projecting radially inwardly into the intake opening 34 and co-operating with toothed cutting edges 42 of the blades 36. The counter knives 40 are bent in spiral shape, and, from the inside to the outside, they increasingly deviate from the radial direction in the direction of the rotation of the impeller (arrow C).

Since the cutting edges 42 of the impeller extend essentially in radial direction, whereas the cutting edges 44 of the counter knives are spiral shaped, the cutting edges cooperate like a pair of scissors when the cutting impeller 38 rotates. The scissor action between the cutting edges meeting each other proceeds essentially radially from the inside to the outside. In the outer portion, the cutting edges 44, however, are curved in a direction opposite to the direction of rotation of the cutting impeller 38 (arrow C).

The cutting edges 42 extend radially outwardly beyond the aperture radius of the intake opening 34 and the cutting edges 44 extend inwardly up to the hub portion of the cutting impeller. Thus, the cutting edges define a window which is closed completely during the cutting operation. This assures that long chippings are sectioned reliably.

The portions of the blades 36 and the counter knives 40 forming the cutting edges are formed for example of hardened steel with a Rockwell hardness of 60 HRC. The hardness and the axial spacing between the cutting edges 42 and 44 have to be determined in accordance with the purpose for which the pump is to be used. It is also possible that the cutting surface of the cutting impeller slides over the intake plate 32. The axial spacing between the cutting edges 42, 44 can be adjusted and varied by means of spacer sheets. For example, the spacer sheets are inserted from the outside between the intake plate 32 and the head 12, so that the distance between the intake plate 32 and the cutting edges 42 is changed.

The toothed shape of the cutting edges 42 of the blades 36 assures that any chips are caught and entrained by the teeth of the cutting edge, are retained during the cutting operation and are then cut. This prevents the chips from shifting radially outwardly along the cutting edge 42. The teeth of the cutting edge 42 may have such a shape that they extend always orthogonally to the corresponding portion of the curved cutting edges 44 of the counter knife (not shown).

As an alternative or in addition, teeth may also be provided on the cutting edges 44 of the counter knives 40.

As is shown in FIG. 1, the shaft 18 is prolonged at its lower end by a smaller-diameter shaft portion 46, which projects beyond the cutting impeller 38 and through the intake funnel 22 into the medium to be sucked in and carries at its lower end a pre-chopper 48 having two blades. According to FIG. 2, the pre-chopper 48 forms two bent cutting edges by which coarse material can be pre-chopped when the pre-chopper 48 rotates together with the cutting impeller 38 and the radial impeller 16.

The shaft portion 46 is surrounded on its entire length by an essentially cylindrical, downwardly tapering sleeve 50 that is secured with its upper end on the radially inner ends of the counter knives 40. The outer periphery of the sleeve 50 forms two axially extending ribs, the outer ends of which are formed with two essentially vertical cutting edges 52 angled against the direction of rotation (arrow C) of the cutting impeller.

When very long chips or other material having long fibers is sucked in by the cutting impeller 38, the fibers would normally have the tendency to wind-up on the shaft portion 46, so that they could no longer be conveyed into the intake opening 34. This is prevented by the sleeve 50 which keeps the fibers away from the shaft portion 46. When the fibers are wound onto the sleeve 50, due to the swirling flow of the medium, they settle against the cutting edges 52. When the top ends of the fibers are caught by the toothed cutting edges 42, the fibers are subject to an additional tension, so that they will firmly engage the cutting edges 52 and will be cut into relatively short pieces which can then be sucked-in by the cutting impeller 38 and can be chopped further. In this way, a stable operation of the pump and a high chopping action are achieved even when the pump works in media that are contaminated with material containing long fibers.

What is claimed is:

1. Pump comprising:

a cutting impeller, counter knives associated with the cutting impeller, a shaft portion that projects axially from the cutting impeller, and a pre-chopper which is driven by the shaft portion that projects axially from the cutting impeller, wherein the counter knives carry a cutting edge that extends in a longitudinal direction of the shaft portion.

2. Pump according to claim 1, wherein the cutting edge extends essentially over an entire length of the shaft portion up to the pre-chopper.

3. Pump according to claim 1, further comprising a sleeve surrounding the shaft portion with the sleeve being non-rotatably held by the counter knives, the cutting edge being formed on an outer periphery of this sleeve.

4. Pump according to claim 3, wherein the sleeve forms a plurality of cutting edges arranged with equal angular spacings.

5. Pump according to claim 3, wherein the cutting edge is formed by an edge of a rib that is formed on the periphery of the sleeve and has a curved cross section and is angled against a direction of rotation of the cutting impeller and the pre-chopper.

6. Pump according to claim 1, wherein the cutting impeller includes cutting edges that are toothed.

* * * * *